United States Patent [19]

Devine

[11] Patent Number: 4,626,128

[45] Date of Patent: Dec. 2, 1986

[54] UNDERWATER GAS POCKET WORK UNIT AND REMOVAL OF DANGEROUS FUMES AND GASES THEREFROM

[76] Inventor: Thomas H. Devine, 147 Jefferson Ave., Chula Vista, Calif. 92010

[21] Appl. No.: 722,285

[22] Filed: Apr. 11, 1985

[51] Int. Cl.[4] ..... B63C 11/52

[52] U.S. Cl. ..... 405/12; 114/221 R; 114/227; 405/192; 405/188

[58] Field of Search ..... 405/188–194, 405/11, 12; 114/315, 221 R, 222, 125, 227, 314, 313, 322, 326, 327, 328, 334

[56] References Cited

U.S. PATENT DOCUMENTS

| | | | |
|---|---|---|---|
| 1,378,843 | 5/1921 | Drake . | |
| 1,800,310 | 4/1931 | McGee | 114/323 |
| 2,667,751 | 2/1954 | Osborn . | |
| 3,279,198 | 10/1966 | Ayers et al. | 52/45 |
| 3,344,614 | 10/1967 | Byck . | |
| 3,386,254 | 6/1968 | Connally . | |
| 3,466,880 | 9/1969 | Elliott | 405/190 |
| 3,623,443 | 11/1971 | Luther | 114/16 E |
| 3,641,777 | 2/1972 | Banjavich et al. | 405/188 |
| 3,702,597 | 11/1972 | Odum et al. | 405/188 |
| 3,857,249 | 12/1974 | Kelly et al. | 114/227 X |
| 3,876,852 | 4/1975 | Topham | 219/72 |
| 4,087,980 | 5/1978 | Kono . | |
| 4,105,887 | 8/1978 | Marshall et al. | 219/72 |
| 4,258,794 | 3/1981 | Sizer et al. | 166/356 |
| 4,288,176 | 9/1981 | Devine | 405/188 |
| 4,362,437 | 12/1982 | Leary | 405/188 |

FOREIGN PATENT DOCUMENTS

| | | | |
|---|---|---|---|
| 1221773 | 2/1971 | United Kingdom | 114/227 |
| 921958 | 4/1982 | U.S.S.R. | 405/12 |

*Primary Examiner*—Dennis L. Taylor
*Attorney, Agent, or Firm*—Edward W. Callan

[57] ABSTRACT

A method of providing a habitable dry work chamber for conducting work on an underwater work surface when the nature of the work is such that dangerous fumes and gases are produced. An underwater gas pocket work unit is attached to the underwater work surface to define a work chamber that may be entered from beneath through the water. The work unit includes a structure consisting of walls defining a work opening, which, when positioned with the work opening at the work surface, defines a work chamber that is accessible only from beneath. The structure is sealed at the work opening to the work surface to define the work chamber, wherein the work chamber is defined solely by the structure and the work surface. A habitable gas that is heavier than the dangerous fumes and gases is caused to flow continuously into the work chamber through a valve in the structure to provide a gaseous pocket in the upper portion of the work chamber when the structure is sealed to the underwater work surface. Gases, including the dangerous fumes and gases, are exhausted from the work chamber through a port located at the uppermost portion of the work chamber and discharged into the water at a predetermined level that defines the water level within the chamber. The disclosed embodiment of the underwater gas pocket work unit is useful for defining an underwater gaseous work chamber adjacent a vertically inclined underwater work surface. A floatation chamber located on the side of the work unit that is opposite the work opening provides buoyancy for forcing the structure against an upwardly and outwardly extending vertically inclined work surface.

8 Claims, 5 Drawing Figures

UNDERWATER GAS POCKET WORK UNIT AND REMOVAL OF DANGEROUS FUMES AND GASES THEREFROM

BACKGROUND OF THE INVENTION

The present invention generally pertains to apparatus and methods used in underwater maintenance and construction and is particularly directed to improvements in underwater gas pocket work units and their use.

An underwater gas pocket work unit is described in Applicant's U.S. Pat. No. 4,288,176. The work unit is adapted for attachment to an underwater work surface to define a work chamber that may be entered from beneath through the water. The work unit includes a structure consisting of continuously joined side walls, and is open at both the top and the bottom. The structure is sealed at the top opening to the work surface, such as the bottom of a ship, to provide a work chamber that is defined solely by the structure and the work surface. A valve is provided through the structure for enabling a gas, such as air, to enter the work chamber to provide a gaseous pocket in the upper portion of the work chamber when the structure is sealed to the underwater work surface. A vent port is provided in at least one of the side walls at a predetermined level that is more remote from the top end of the structure than the valve for enabling gas to flow from the gaseous pocket into the water outside the work chamber when the top end of the structure is sealed to the underwater work surface to thereby define the water level within the work chamber and limit the maximum depth of the gaseous pocket. The side walls of the structure each contain both inner and outer walls defining floatation chambers into which air may be admitted to control the buoyancy of the structure so as to force the work unit up against the work surface. A resilient gasket is provided at the opening at the top end of the structure to effect a seal between the structure and the work surface when the work unit is forced up against the work surface. Such prior art work unit is limited in its application to use with work surfaces that do not deviate greatly from the horizontal.

A safety concern that has arisen in relation to the use of underwater gas pocket work units is the maintenance of a habitable environment in the work chamber when the nature of the work is such that dangerous fumes and gases are produced therein.

SUMMARY OF THE INVENTION

The method of the present invention provides a habitable dry work chamber for conducting work on an underwater work surface when the nature of the work is such that dangerous fumes and gases are produced. An underwater gas pocket work unit is attached to the underwater work surface to define a work chamber that may be entered from beneath through the water. The work unit includes a structure consisting of walls defining a work opening, which, when positioned with the work opening at the work surface, defines a work chamber that is accessible only from beneath. The structure is sealed at the work opening to the work surface to define the work chamber, wherein the work chamber is defined solely by the structure and the work surface. A habitable gas that is heavier than the dangerous fumes and gases is caused to flow continuously into the work chamber through a valve in the structure to provide a gaseous pocket in the upper portion of the work chamber when the the structure is sealed to the underwater work surface. Gases, including the dangerous fumes and gases, are exhausted from the work chamber through a port located at the uppermost portion of the work chamber and discharged into the water at a predetermined level that defines the water level within the chamber.

The present invention further provides an improved underwater gas pocket work unit that is useful for defining an underwater gaseous work chamber adjacent a vertically inclined underwater work surface.

The work unit according to this aspect of the present invention includes a structure consisting of a top end wall and side walls defining a side opening, which, when positioned with the side opening at the work surface, defines a work chamber that is accessible only from beneath. The work chamber is defined solely by the structure and the work surface. The work unit further includes means for sealing the structure at the side opening to the work surface to define the work chamber and a valve in the structure for enabling a gas to enter the work chamber to provide a gaseous pocket in the upper portion of the work chamber when the the structure is secured to the underwater work surface. The seal between the structure and the work surface may be enhanced by providing a floatation chamber at the portion of the side wall on the opposite side of the structure from the side opening, whereby the buoyancy of the floatation chamber is controlled to force the structure against an upwardly and outwardly vertically inclined work surface.

In another aspect, the present invention provides an underwater gas pocket work unit that is particularly adapted for enabling the removal of dangerous fumes and gases, such as are produced during welding or painting, from the work chamber. Such fumes and gases are lighter than air and rise to the top of the work chamber. This aspect of the invention is applicable to both the work units that are adapted for use with vertically inclined work surfaces and the work units that are adapted for use with work surfaces that do not deviate greatly from the horizontal. A work unit according to this aspect of the present invention includes a structure consisting of walls defining a work opening, which, when positioned with the work opening at the work surface, defines a work chamber that is accessible only from beneath; means for sealing the structure at the work opening to the work surface to define the work chamber, wherein the work chamber is defined solely by the structure and the work surface; and a valve in the structure for enabling a gas to enter the work chamber to provide a gaseous pocket in the upper portion of the work chamber when the the structure is sealed to the underwater work surface; and is characterized by venting apparatus for exhausting gases from the work chamber through a port located at the uppermost portion of the work chamber and for discharging the exhausted gases into the water at a predetermined level that defines the water level within the chamber.

Additional features of the present invention are described with reference to the description of the preferred embodiment.

DESCRIPTION OF THE PREFERRED EMBODIMENT

Figure 1:
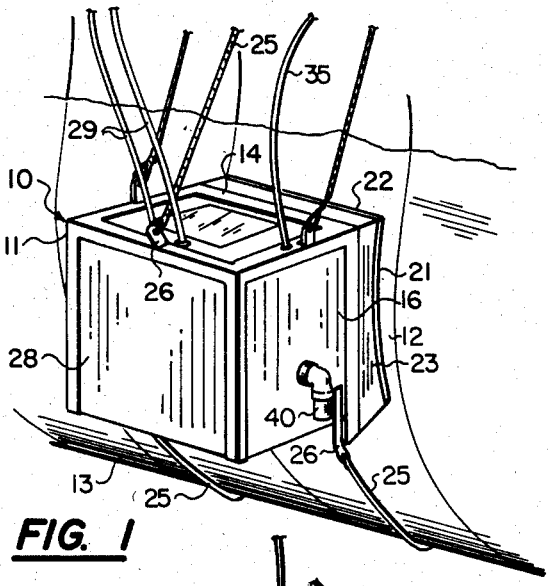
FIG. 1 is a perspective view of a preferred embodiment of the work unit of the present invention as secured to an underwater work surface.
Figure 2:
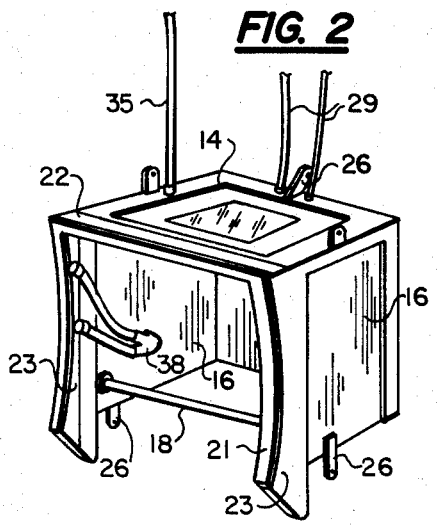
FIG. 2 is a perspective view of the work unit of FIG. 1 as viewed from the opposite side.
Figure 3:
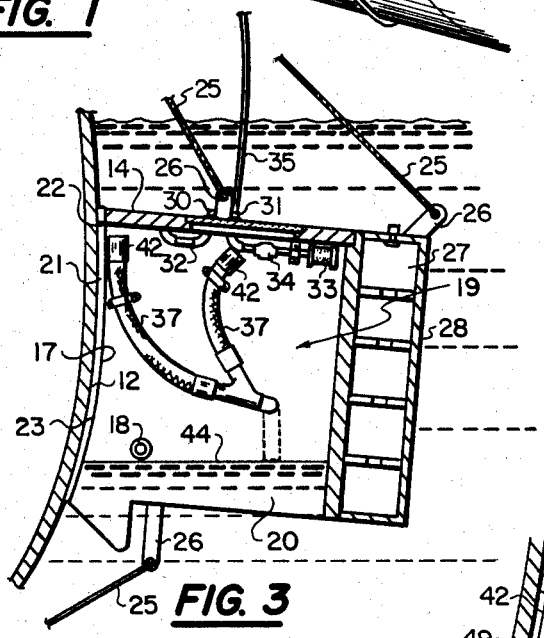
FIG. 3 is a side plan view of the work unit of FIG. 1, with portions cut away, showing the work unit as secured to an under water work surface.
Figure 5:
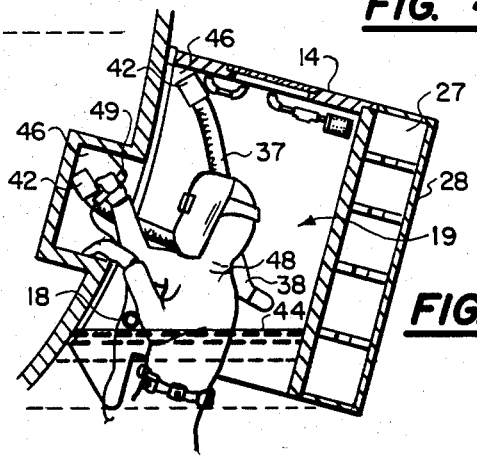
FIG. 5 is side plan view of the work unit of FIG. 1, with portions cut away, showing the work unit in use as secured to an irregular underwater work surface.

Referring to FIG. 1, a preferred embodiment of a work unit 10 is shown attached to a vertically inclined underwater work surface 12, such as the side of a ship 13. The work unit 10 includes a structure 11 having a top end wall 14, and three side walls 16. The side walls 16 define a side opening 17, as shown in FIG. 2. A support rod 18 extends between the side walls 16 near the side opening 17. When the work unit 10 is positioned with the side opening 17 at the work surface 12, as shown in FIGS. 1, 3 and 5, the structure 11 and the work surface 12 define a work chamber 19 that is accessible only from beneath through the water 20. A resilient gasket 21 is attached to the end portion 22 of the top end wall 14 and to the end portions 23 of the side walls 16 that terminate at the side opening 17 in order to seal the structure 11 to the work surface 12. The end portions 23 of the side walls 16 that terminate at the side opening 17 are contoured to correspond to the contour of the work surface 12. The work unit 10 is secured to the ship 13 by cables 25 attached to brackets 26 that are secured to the work unit 11, as shown in FIGS. 1 and 3. The work unit also includes a floatation chamber 27 at the portion 28 of the side wall 16 that is opposite the side opening 17 for providing buoyancy to force the structure 11 against an upwardly and outwardly vertically inclined work surface 12, when the structure 12 is secured by the cables 25 to the work surface 12 at the side opening 17. The amount of floatation is regulated by the amount of air that is admitted into and removed from the floatation chamber 27 through the hoses 29. Two valves 30 and 31 are located in the top end wall 14 of the structure 11 for enabling a gas to enter the work chamber 19. Usually, only one valve 31 is used for admitting air into the work chamber 19. The other valve 30 is connected to a pipe 32, which is capped at the other end. An air diffuser 33 is attached to the valve 31 by a pipe 34 for admitting air into the work chamber 19. Air is provided to the valve 31 by a hose 35. The other valve 30 is included in the structure 11 for use as an additional or alternative inlet for admitting air into the work chamber 19, in which case an air diffuser would be substituted for the cap at the other end of the pipe 32. Air admitted into the work chamber 19 through the valve 31 and the air diffuser 33 provides a gaseous pocket in the upper portion of the work chamber 19 when the structure 11 is sealed to the underwater work surface 12. Air is pumped through the hose 35 and the valve 31 to cause the air to flow continuously into the work chamber 19.

Figure 4:
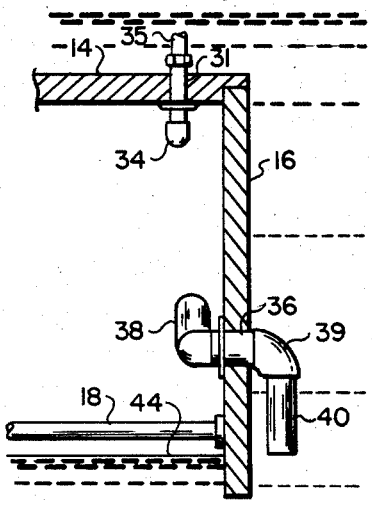
FIG. 4 is a different side plan view of a portion of the work unit of FIG. 1, with portions cut away to show a valve included in the venting apparatus for exhausting gases from the work chamber.

A venting apparatus is provided for exhausting gases from the upper portion of the work chamber. The venting apparatus includes a valve 36 (FIG. 4) in one side wall 16 of the structure 11, hoses 37, a first pipe fitting 38, a second pipe fitting 39 and an air diffuser 40. The hoses 37 are attached to the valve 36 within the work chamber 19 by the pipe fitting 38. The hoses 37 are clamped to the inside of the side wall 16 to position the free ends 42 of the hoses 37 at the uppermost portions of the work chamber 19 to thereby provide ports 42 at the uppermost portions of the work chamber 19 for receiving and exhausting gases from the uppermost portions of the work chamber 19. The air diffuser 40 is connected to the valve 36 at the outside of the structure 11 by the pipe fitting 39 for discharging the exhausted gases into the water 20 at a predetermined level that defines the water level 44 within the work chamber 19. Air is exhausted from the work chamber 19 through the hoses 37, the valve 36 and the air diffuser 40 because of the pressure differential between the inside of the work chamber 19 and the water 20 at the level of the air diffuser 40.

Sometimes, the underwater work surface is irregular, such as the work surface defined by a sea chest in the hull of a ship. As a result, a plurality of recesses 46 are formed in the upper portion of the work chamber 19, as shown in FIG. 19. FIG. 5 further depicts a welder 48 conducting dry welding with a welding torch 49 in one of the recesses 46. When this type of work environment is encountered, the hoses 37 are clamped to the side wall 16 so as to locate at least one port 42 within each recess 46.

What is claimed is:

1. An underwater gas pocket work unit for attachment to an underwater work surface to define a work chamber that may be entered from beneath through the water, for use with an irregular work surface, whereby a plurality of recesses are defined in the upper portion of the work chamber, comprising a structure consisting of a top end wall and side walls defining a side opening, which, when positioned with the side opening at the work surface, defines a work chamber that is accessible only from beneath;

means for sealing the structure at the side opening to the work surface to define said work chamber, wherein the work chamber is defined solely by the structure and the work surface;

valve means in the structure for enabling a gas to enter the work chamber to provide a gaseous pocket in the upper portion of the work chamber when the structure is sealed to the underwater work surface;

venting means for exhausing gases from the work chamber through a port located at the uppermost portion of the work chamber, wherein the venting means comprise a pluraltiy of said ports, with at least one port being positionable in the uppermost portion of each recess.

2. An underwater gas pocket work unit according to claim 1, wherein the venting means comprises second valve means in the structure for exhausting said gases from the work chamber; and a plurality of hoses corresponding to the number of said ports, wherein one end of each hose is connected to the second valve means and the other end of each hose is positionable in one of said recesses for defining one of said ports.

3. An underwater gas pocket work unit for attachment to an underwater work surface to define a work chamber that may be entered from beneath through the water, comprising a structure consisting of walls defining a work opening, which, when positioned with the work opening at the work surface, defines a work chamber that is accessible only from beneath;

means for sealing the structure at the work opening to the work surface to define said work chamber, wherein the work chamber is defined solely by the structure and the work surface;

valve means in the structure for enabling a gas to enter the work chamber to provide a gaseous pocket in the upper portion of the work chamber when the the structure is sealed to the underwater work surface; and venting means for exhausting gases from the work chamber through a port located at the uppermost portion of the work chamber and for discharging the exhausted gases into the water at a predetermined level that defines the water level within the chamber.

4. An underwater gas pocket work unit according to claim 3, for use with an upwardly and outwardly vertically inclined work surface, wherein the structure consists of a top end wall and side walls defining a side opening, and wherein the work unit further comprises a floatation chamber at the portion of the side wall that is opposite the side opening for providing buoyancy to force the structure against the upwardly and outwardly vertically inclined work surface when the structure is secured to the work surface at the side opening.

5. An underwater gas pocket work unit according to claim 3 for use with an irregular work surface, whereby a plurality of recesses are defined in the upper portion of the work chamber, wherein the venting means comprise a plurality of said ports, with at least one port being located in the uppermost portion of each recess.

6. An underwater gas pocket work unit according to claim 5, wherein the venting means comprises second valve means in the structure for exhausting said gases from the work chamber; and a plurality of hoses corresponding to the number of said ports, wherein one end of each hose is connected to the second valve means and the other end of each hose is positionable in one of said recesses for defining one of said ports.

7. A method of providing a habitable dry work chamber for conducting work on an underwater work surface when the nature of the work is such that dangerous fumes and gases are produced, comprising the steps of (a) attaching an underwater gas pocket work unit to the underwater work surface to define a work chamber that may be entered from beneath through the water, wherein the work unit includes a structure consisting of walls defining a work opening, which, when positioned with the work opening at the work surface, defines a work chamber that is accessible only from beneath;

(b) sealing the structure at the work opening to the work surface to define the work chamber, wherein the work chamber is defined solely by the structure and the work surface;

(c) causing a habitable gas that is heavier than the dangerous fumes and gases to continuously flow into the work chamber to provide a gaseous pocket in the upper portion of the work chamber when the the structure is sealed to the underwater work surface; and (d) exhausting gases including the dangerous fumes and gases from the work chamber through a port located at the uppermost portion of the work chamber and discharging the exhausted gases into the water at a predetermined level that defines the water level within the chamber.

8. A method according to claim 7 for use with an irregular work surface, whereby a plurality of recesses are defined in the upper portion of the work chamber, wherein step (d) comprises the step of (e) exhausting the dangerous fumes and gases through ports located in the uppermost portion of each recess.

* * * * *